US007443348B2

(12) United States Patent
Fortson et al.

(10) Patent No.: US 7,443,348 B2
(45) Date of Patent: Oct. 28, 2008

(54) OMNI-DIRECTIONAL ANTENNA

(75) Inventors: Frederick O. Fortson, Whitmore Lake, MI (US); Richard Hansen, Ann Arbor, MI (US); Greg Soosik, Canton, MI (US)

(73) Assignee: Solidica, Inc., Ann Arbor, MI (US)

( * ) Notice: Subject to any disclaimer, the term of this patent is extended or adjusted under 35 U.S.C. 154(b) by 0 days.

(21) Appl. No.: 11/755,265

(22) Filed: May 30, 2007

(65) Prior Publication Data

US 2008/0030406 A1 Feb. 7, 2008

Related U.S. Application Data

(60) Provisional application No. 60/809,257, filed on May 30, 2006.

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846, 815, 833, 834, 829
See application file for complete search history.

(56) References Cited

U.S. PATENT DOCUMENTS 3,144,646 A * 8/1964 Breithaupt ..... 342/105
3,605,104 A * 9/1971 Weston et al. ..... 343/837
4,700,197 A * 10/1987 Milne ..... 343/837
5,745,079 A * 4/1998 Wang et al. ..... 343/700 MS
6,765,536 B2 * 7/2004 Phillips et al. ..... 343/702
7,002,521 B2 * 2/2006 Egawa et al. ..... 343/702

* cited by examiner

*Primary Examiner*—Tho G Phan
(74) *Attorney, Agent, or Firm*—Gifford, Krass, Sprinkle, Anderson & Citkowski, PC

(57) ABSTRACT

An omni-directional antenna includes an electrically conductive ground plane, an electrically conductive parasitic disc spaced upwardly apart from the ground plane and parallel thereto, and an electrically conductive vertical antenna element extending up through the center of the ground plane and parasitic disc, The vertical element terminates in a tip defining a length above the parasitic disc that is matched to a frequency of interest. The parasitic disc and ground plane are preferably both circular. To prevent electrical connection, the vertical element preferably extends through separate insulators in the parasitic disc and ground plane. The length of the vertical element is matched to a microwave frequency; in particular, the length of the vertical element is proportioned to one-quarter wavelength of the frequency of interest. The invention is particularly suited to microwave frequencies.

10 Claims, 1 Drawing Sheet

OMNI-DIRECTIONAL ANTENNA

REFERENCE TO RELATED APPLICATION

This application claims priority from U.S. provisional Pat. application Ser. No. 60/809,257, filed May 30, 2006, the entire content of which is incorporated herein by reference.

FIELD OF THE INVENTION

This invention relates generally to omni-directional antennas and, in particular, to an omni-directional antenna including a parasitic disc spaced apart from a ground plane to improve omni-directionality.

BACKGROUND OF THE INVENTION

Directional antennas are preferred where the relationship between the sender and receiver are known geographically. In such arrangements, directionality maximizes the power of transmission from sender to receiver.

Omni-directional antennas are a better choice where the location of the recipient is either not known a priori, or in situations where the sender and/or receiver may be mobile. Omni-directional antennas are therefore typically used in local-area network (LAN) and wireless (i.e., wi-fi) environments.

Broadly speaking, an omni-directional antenna radiates power substantially uniformly in all directions. The only three-dimensional omni-directional antenna is the isotropic antenna, a theoretical construct derived from actual radiation patterns and used as a reference for specifying antenna gain and effective radiated power. Practical antennas approach omni-directionality by providing uniform radiation or response only in one reference plane, usually the horizontal plane parallel to the earth's surface. Common omni-directional antennas include the whip antenna, the vertically oriented dipole antenna, the discone antenna and the horizontal loop antenna. While these designs perform adequately in some situations, the need always remains for new configurations for emerging applications.

SUMMARY OF THE INVENTION

This invention resides in an omni-directional antenna particularly suited to wi-fi, mesh networks and other applications. The preferred embodiment includes an electrically conductive ground plane, an electrically conductive parasitic disc spaced upwardly apart from the ground plane and parallel thereto, and an electrically conductive vertical antenna element extending up through the center of the ground plane and parasitic disc. The vertical element terminates in a tip defining a length above the parasitic disc that is matched to a frequency of interest.

In the preferred embodiment the parasitic disc and ground plane are both circular. In typical configurations the diameter of the parasitic disc is smaller than the length of the vertical element, while the diameter of the ground plane is larger than the length of the vertical element. The invention is not constrained to these relationships, however.

To prevent electrical connection, the vertical element extends through separate insulators in the parasitic disc and ground plane. The length of the vertical element is matched to a microwave frequency; in particular, the length of the vertical element is proportioned to one-quarter wavelength of the frequency of interest. The invention is particularly suited to microwave frequencies. The vertical element is preferably perpendicular to the parasitic disc and ground plane. The vertical element may be used for transmitting, receiving, or both.

DETAILED DESCRIPTION OF THE INVENTION

Figure 1:
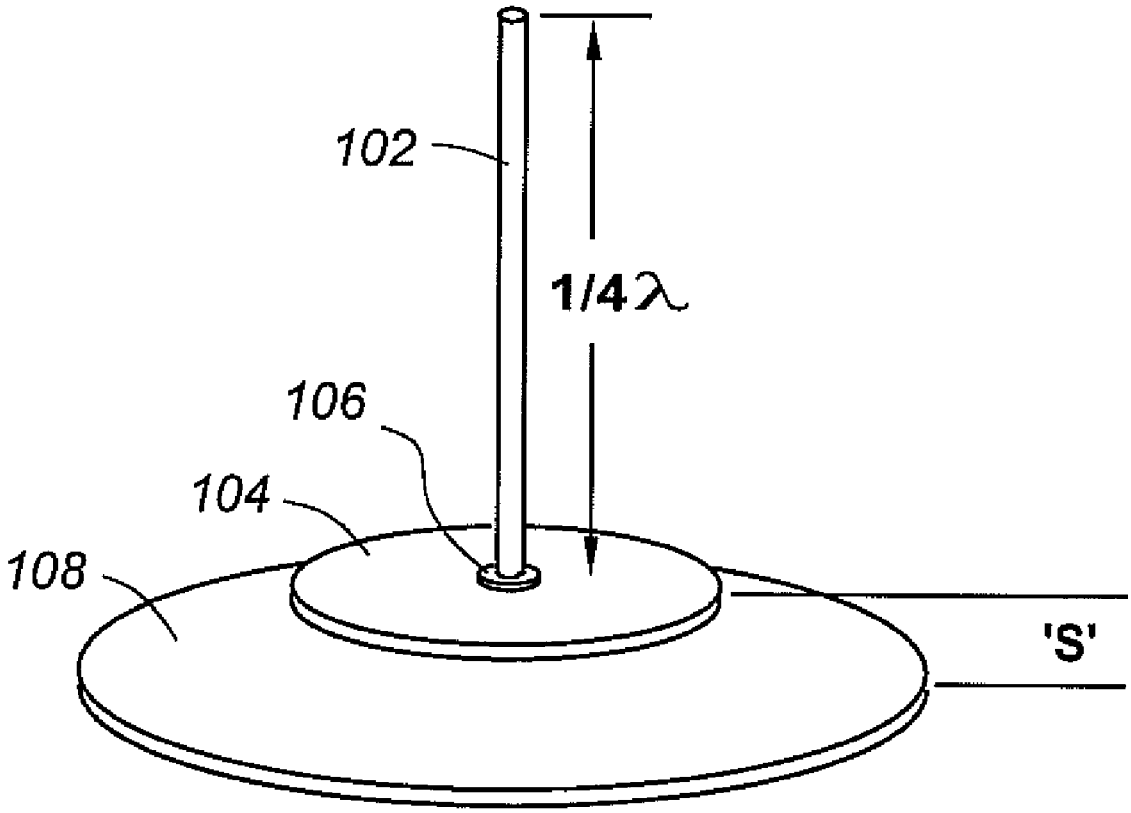
FIG. 1 is a perspective view drawing that shows the preferred embodiment of the invention.

This invention resides in a novel omni-directional antenna utilizing a vertical post and a plurality of discs. The preferred embodiment is illustrated in FIG. 1. The element 102 extends down through an electrical insulator 106, past disc 104, and through ground plane 108 other insulator not shown). The vertical element 102 has a length above the disc 104 which proportioned to one-quarter wavelength of the frequency of interest.

An important aspect of the invention is the use of the parasitical floating plate 104, spaced at a distance S above the ground plane 108. It has been found experimentally that utilizing the configurations and proportions shown in the figure, results in a true omni-directional broadband mesh centered around the frequency of interest. S may be varied, particularly in conjunction with a field-strength meter, to optimize radiation profile for a given application. The various components may be made of any suitable electrically conductive material, such as aluminum, copper, and so forth, with the exception of the spacers 106, which are nylon or an alternative electrical insulator.

The antenna finds many applications including wi-fi, mesh networks and other uses. For example, the element 102 may be sized for a center frequency at 2.4 gigahertz or other microwave frequencies of interest. Importantly, low-temperature additive manufacturing processes may be used to embed electronics into the ground plane 108, for example. Specifically, ultrasonic consolidation may be used to embed switches, preamplifiers, or other electronics directly into the plane 108 to control amplification immediately before transmission or reception. A send-receive switch may also be embedded in this manner.

We claim:

1. An omni-directional antenna comprising:

an electrically conductive ground plane;

an electrically conductive parasitic disc spaced upwardly apart from the ground plane and parallel thereto; and an electrically conductive vertical antenna element extending up through the center of the ground plane and parasitic disc, the vertical element terminating in a tip defining a length above the parasitic disc that is matched to a frequency of interest.

2. The omni-directional antenna of claim 1, wherein the parasitic disc is circular.

3. The omni-directional antenna of claim 2, wherein the diameter of the parasitic disc is smaller than the length of the vertical element.

4. The omni-directional antenna of claim 1, wherein the ground plane is circular.

5. The omni-directional antenna of claim 4, wherein the diameter of the ground plane is larger than the length of the vertical element.

6. The omni-directional antenna of claim 1, wherein the vertical element extends through an insulator in the parasitic disc to prevent electrical connection thereto.

7. The omni-directional antenna of claim 1, wherein the vertical element extends through an insulator in the ground plane to prevent electrical connection thereto.

8. The omni-directional antenna of claim 1, wherein the length of the vertical element is matched to a microwave frequency.

9. The omni-directional antenna of claim 1, wherein the length of the vertical element is proportioned to one-quarter wavelength of the frequency of interest.

10. The omni-directional antenna of claim 1, wherein the vertical element is perpendicular to the parasitic disc and ground plane.

* * * * *